US005301432A

United States Patent [19]

Richardson et al.

[11] Patent Number: 5,301,432

[45] Date of Patent: Apr. 12, 1994

[54] RING WITH MOVABLE BLADE

[76] Inventors: Stanley G. Richardson; Derry J. Richardson, both of 261 Kenilworth Ave. No., Hamilton, Ontario, Canada, L8H 4S6

[21] Appl. No.: 990,586

[22] Filed: Dec. 15, 1992

[51] Int. Cl.[5] ..... B26B 27/00

[52] U.S. Cl. ..... 30/298; 7/121; 30/291

[58] Field of Search ..... 30/298, 289, 290, 291, 30/320, 321, 1, 298.4; 7/169, 170, 121; 294/25; D8/98

[56] References Cited

U.S. PATENT DOCUMENTS

| | | | |
|---|---|---|---|
| 128,316 | 6/1872 | Laffray | 30/298 |
| 647,862 | 4/1900 | McLaughlin | 30/298 |
| 681,978 | 9/1901 | Richardson | 30/291 |
| 1,379,864 | 5/1921 | Gregory | 30/291 |
| 1,599,126 | 9/1926 | Freeman | 30/291 |
| 2,611,953 | 9/1952 | Bruening | 30/298 |
| 3,648,371 | 3/1972 | Petrosky . | |
| 4,087,911 | 5/1978 | Schrock et al. . | |
| 4,665,859 | 5/1987 | Dunlap et al. . | |
| 4,885,818 | 12/1989 | Arterbury . | |
| 5,038,479 | 8/1991 | Davis . | |

FOREIGN PATENT DOCUMENTS

| | | |
|---|---|---|
| 219333 | 6/1922 | Canada . |
| 234221 | 9/1923 | Canada . |

*Primary Examiner*—Douglas D. Watts
*Assistant Examiner*—Hwei-Siu Payer
*Attorney, Agent, or Firm*—Moss, Barrigar & Oyen

[57] ABSTRACT

A ring blade for cutting or for defensive purposes comprises a ring with a top section and a movable crown member mounted in this top section. The ring is adapted for placement on a person's finger. The crown member has an elongate slot formed therein and a blade member is arranged in this slot. First and second pin members are provided to pivot the blade member from a retracted position where the blade is located in the slot to an extended position where the blade is exposed. The blade member is connected to the top section by one of the pin members and it is connected to the crown member by the other pin member. Movement of the crown member towards the top section causes the pin members to pivot the blade member to the extended position. Preferably the top section has a V-shaped cavity and the crown member is also V-shaped so as to fit inside this cavity.

20 Claims, 2 Drawing Sheets

RING WITH MOVABLE BLADE

BACKGROUND OF THE INVENTION

This application relates to ring blades or ring knives which are adapted for placement on a user's finger and which can be used for cutting.

Ring blades or ring knives are known and they have been used in the past to cut twine or thread or to cut plant stems. Some of the known ring knives have retractable blades so that the device can be carried relatively safely when it is not in use.

Early Canadian patent No. 219,333 issued Jun. 6, 1922 to O. L. Raymer describes a twine cutter comprising a ring and a cutter blade pivotally supported to project from the ring in a plane at right angles with the plane of the ring. There is a mechanism locking the blade in the open position When not in use, the blade can be folded into the ring so that the device can safely be carried in one's pocket. One difficulty with this known ring is that the ring device cannot be worn when the blade is moved to the retracted position. Thus, the blade is not available for immediate use and it is necessary to take the ring device and place it on one's finger after extending the blade to the open position. Accordingly, this known ring is not particularly suitable for use for defensive purposes.

Canadian patent No. 234,221 which issued Sep. 18, 1923 to P. P. Binkis describes a ring knife which also has a retractable blade. The blade is mounted in an elongate slit formed in the crown. The blade is fitted with an upper guide which can be moved by the user's finger in order to expose the sharpened edge of the blade. There is also a locking pin capable of locking the knife in either its operating position or in a retracted position. Because of the shape of the blade and its position relative to the crown of the ring, this known device is not believed to be particularly suitable as a defence ring.

Much more recent U.S. Pat. No. 3,648,371 which issued Mar. 14, 1972 to Charles Petrosky does describe a ring with a blade intended for defensive purposes. The ring is fitted with a downwardly pointed triangular blade with sharpened cutting edges and this blade is fixed in its position. This ring also has stabilizing wings which extend laterally from the ring. Because of the stabilizing wings and because the blade is fixed and exposed at all times, the ring is not particularly suitable for wearing at all times and under all circumstances. Because the blade is always exposed, there is a danger that it might inadvertently rip or tear an adjacent object or person causing undesirable damage or injury.

It is an object of the present invention to provide a relatively inexpensive ring blade which has a blade member which can be pivoted from a retracted position to an extended position where the sharp edge of the blade is exposed. The blade member is mounted in a slot in a movable crown and movement of the crown towards the adjacent top section of the ring will cause a pin mechanism to pivot the blade member to the extended position.

It is a further object of the present invention to provide a relatively simple ring blade with a pivotally mounted crown member having an elongate slot in which a blade member is mounted. The preferred ring blade can be worn at all times, even if the blade member is in the retracted position and the blade member can be pivoted to an extended position where its sharp edge is exposed by applying suitable pressure or force to the crown of the ring blade.

SUMMARY OF THE INVENTION

According to one aspect of the invention, a ring blade comprises a ring with a top section, the ring being adapted for placement on a user's finger, and a movable crown member mounted on the top section and having an elongate slot formed therein. A blade member having a sharp edge is arranged in this slot. A pin mechanism is capable of pivoting the blade member from a retracted position where the sharp edge at least is located in the slot to an extended position where the sharp edge is exposed. The blade member is connected to the top section by the pin mechanism. Movement of the crown member towards the top section causes the pin mechanism to pivot the blade member to the extended position.

Preferably the top section of the ring has a V-shaped cavity with an open top and the crown member is also V-shaped and fits inside the cavity. The shape of the crown member indicates the direction in which force or pressure must be applied to the crown member to cause the blade to be exposed.

According to another aspect of the invention, a ring blade for cutting comprises a ring suitable for placement on a user's finger, the ring having a top section with a cavity formed therein, and a crown member pivotally mounted in this cavity and having an elongate slot formed therein. A blade member having a sharp edge is arranged in the slot. There are means connected to the blade member for pivoting the blade member from a retracted position where at least the sharp edge is located in the slot to an extended position where the sharp edge is exposed. The pivoting mechanism is operated by pivoting the crown member.

The preferred pivoting mechanism comprises a first pin member pivotally connecting the blade member to the top section of the ring and a second pin member that connects the blade member to the crown member.

Further features and advantages of this ring blade will become apparent from the following detailed description taken in conjunction with the drawings.

DESCRIPTION OF PREFERRED EMBODIMENTS

Figure 1:
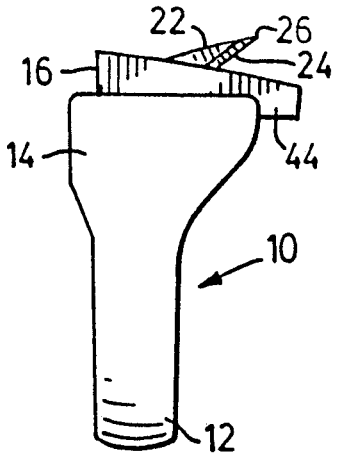
FIG. 1 is a side edge view of a ring blade constructed in accordance with the invention.
Figure 2:
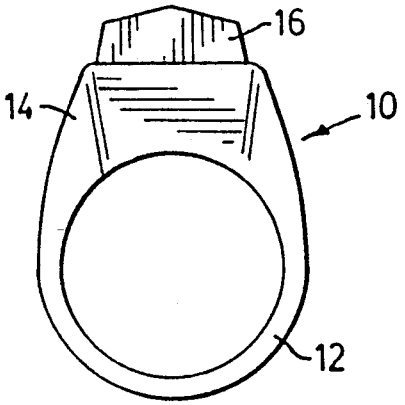
FIG. 2 is a rear view of the ring blade of FIG. 1.
Figure 4:
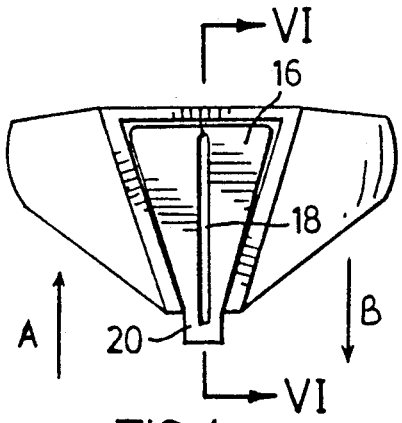
FIG. 4 is a top view of the ring blade of FIG. 1 with the crown member mounted in place.

FIGS. 1 and 2 show a ring blade 10 constructed in accordance with the invention. The particular ring blade illustrated is a slim design suitable for a woman. The ring is formed with the usual loop 12 that is sized for placement of the ring blade on a person's finger. The ring has an enlarged top section 14 and a movable crown member 16 is mounted on this top section. This crown member has an elongate slot formed therein as shown in FIG. 4. This slot 18 preferably extends in a lengthwise direction of the crown member which preferably has the V-shaped shown in FIG. 4. The slot extends from a point 20 close to the point of the V-shape and substantially divides the Crown member into two halves.

A blade member 22 having a sharp edge 24 is arranged in the slot 18. The blade member has a sharp point 26 and the point and the sharp edge of the blade are exposed when the blade member is in an extended position.

Figure 6:
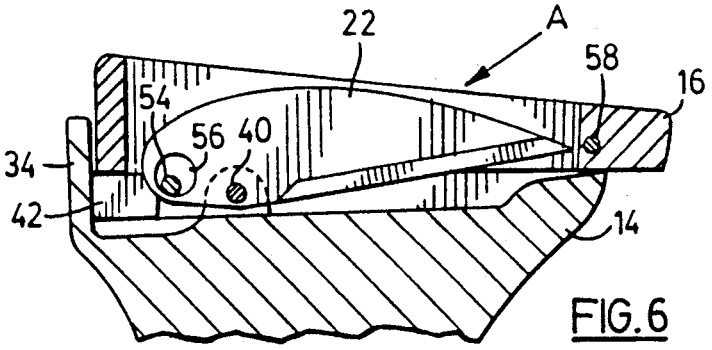
FIG. 6 is a sectional view of the top section, crown member and blade of the ring blade taken along the line VI—VI of FIG. 4.

There is a pin mechanism or pin means for pivoting the blade member 22 from a retracted position such as that shown in FIG. 6 to an extended position where the blade's sharp edge and point are exposed. Although in a preferred embodiment the blade member is located completely within the slot 18 when it is retracted, clearly the ring blade could be constructed so that only the sharp edge portion of the blade is located in the slot in the retracted position. However, it is preferable that the blade member be located fully within the slot in the retracted position so that the ring blade will have a normal, pleasing appearance with the blade retracted. The blade member 22 is connected to the top section 14 by the pin mechanism. Pivotal movement of the crown member towards the top section causes the pin mechanism to pivot the blade member to the extended position.

Figure 3:
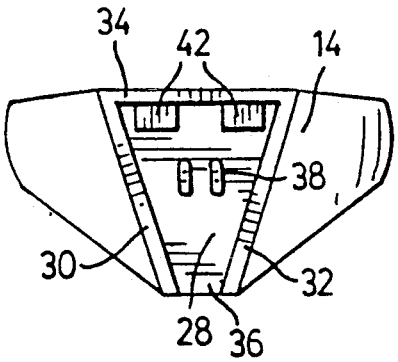
FIG. 3 is a top view of the ring with the crown member and blade removed.

The top section 14 preferably is constructed with a V-shaped cavity 28 which accommodates snugly the crown member 16. The fit between the sides of the cavity and the crown member must be sufficiently loose however to permit the pivotal movement to be described The cavity 28 has an open top, two side walls 30 and 32 which taper towards one another. and an end wall 34. The narrow end of the cavity is open at 36 in the embodiment of FIGS. 1 to 4. Mounted centrally in the cavity are two upwardly extending lugs 38. In these lugs is mounted a short steel pin, herein referred to as the first steel pin 40. The pin 40 extends through a hole at one end of the blade member as indicated in FIG. 6. Thus, the pin 40 connects the blade member to the top of the ring. Also mounted in the cavity is a resilient, vulcanized rubber spring or pad 42. There may be a couple of the pads 42 as shown in FIG. 3, if desired. The pads 42 can be mounted adjacent one end of the cavity 28 as shown in FIG. 3. In this position it is more difficult to expose the blade member as the resistance of the pads to pivotal movement is greater. The pads can also be mounted more centrally in the cavity as shown in the ring blade of FIG. 9, in which case it is easier to pivot the crown member.

Figure 5:
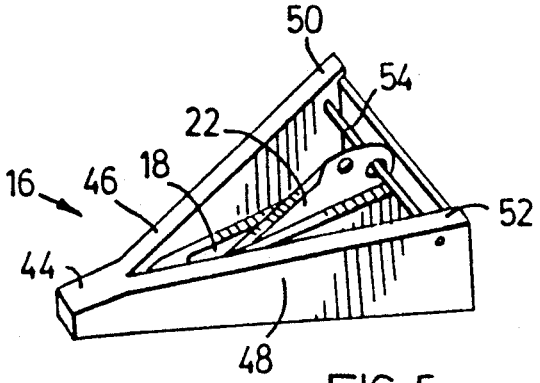
FIG. 5 is a perspective view showing the bottom of a preferred form of crown member with a blade connected thereto.

The preferred construction of the crown member for a lady's ring can be seen from FIG. 5 which shows that this member is hollow with an open bottom. The crown member has an end section 44 which projects from the V-shaped cavity of the ring as shown in FIGS. 1 and 4. The crown member also has two side walls 46 and 48 which taper outwardly from one another from end section 44. Two lugs 50 and 52 extend downwardly from the side walls at the wide end of the crown member and in these lugs is supported a second steel pin 54. This steel pin extends through an enlarged opening 56 in the blade member as shown in FIG. 6. The second steel pin 54 pivotally connects the blade member to the crown member 16. There is a third pin member 58 that pivotally connects the narrow front section 44 to the top section of the ring.

The manner in which the blade member operates can be readily seen from FIG. 6. By appropriate pressure on the crown member 16, for instance in the direction of the arrow A, the crown member will pivot in a counterclockwise direction, compressing the pad or pads 42. This will cause the second steel pin 54 to press down on the wide end of the blade member, causing it to pivot so that it extends almost perpendicularly from the top surface of the crown member. In this position, the ring blade can be used as a defensive weapon, for example, to ward off attacks, if desired. In order to use the ring in this manner the hand on which the ring is placed is clenched into a fist, thus enabling the user to press the crown member of the ring against the surface to be scratched or torn.

Figure 7:
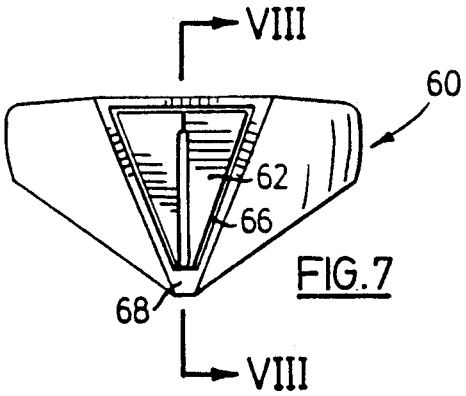
FIG. 7 is a top view of a second embodiment of the ring blade wherein the crown member fits entirely within the cavity formed in the top section of the ring.
Figure 8:
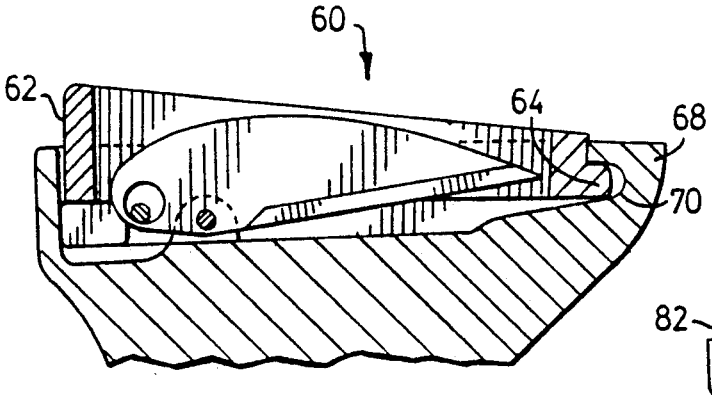
FIG. 8 is a sectional view taken along the line VIII—VIII of FIG. 7 showing the top section of the ring with a crown and blade mounted therein.

An alternative embodiment of the ring blade is shown in FIGS. 7 and 8. This embodiment 60 is similar to the first embodiment 10 except for the differences explained hereinafter. In particular, in this embodiment there is no pin at the narrow end of the crown member to connect the crown member to the top of the ring. Instead, the narrow end of the crown member 62 is formed with a protruding lip 64. A V-shaped cavity 66 formed in the top section of the ring is closed at 68 and at this pointed end of the cavity it is undercut as shown at 70 in FIG. 8. The recess formed by the undercut accommodates the lip 64 and, in this way, the pointed end of the crown member is pivotally mounted in and held in the cavity.

Preferably the blade member 22 is made from a stainless steel surgical blade that will not rust with the passage of time. Also, in a preferred embodiment, the blade member is rodium plated which in addition to preventing rust also helps to prevent an allergic reaction in some users. In a lady's version of the ring, the blade member is preferably about a half inch long and, when fully extended, it protrudes about ¼ inch from the top of the crown. The blade of this version is 0.5 mm thick.

The hardened steel pins used to connect the blade member to the crown and the top of the ring can be quite short with the first pin 40 being only about ⅛ inch long. The second pin that connects the blade member to the crown is about 5/16 inch.

Figure 9:
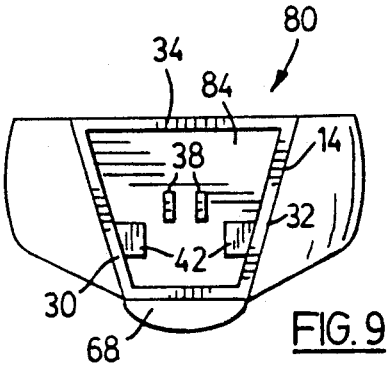
FIG. 9 is a top view of another embodiment, a man's ring, with the crown member and blade removed.
Figure 10:
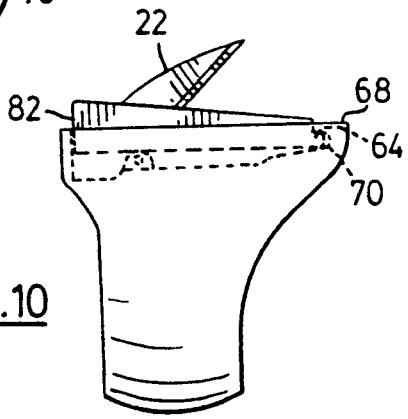
FIG. 10 is a side edge view of the complete ring blade of FIG. 9.

FIGS. 9 and 10 illustrate a man's version of a ring blade constructed according to the invention. This version 80 is wider with a trapezoidal shaped crown member 82 located in a wider, trapezoidal shaped cavity 84. The blade member 22 can also be made larger. In one embodiment the blade member 22 is ¾ inch long and it is exposed ½ inch when fully pivoted. This bigger blade can be 1 mm thick.

The present ring blade can be constructed from a variety of different metals and also of suitable, strong plastics materials. For example, the ring and the crown can be made of silver, brass or gold ranging from 9K to 24K. These members could also be gold-plated if desired. Preferably the rubber used for the pads 42 is medium hard rubber. Plastic or non-precious metal versions of the ring blade could be made for military purposes.

Preferably, the ring blade is constructed so that activation of the blade member occurs when force is applied to the crown member in a direction indicated by the arrow A in FIG. 4 which is opposite the direction in which the V-shaped crown member points. This activation is due in part to the slope of the top of the ring blade. Thus, a user of the ring will know at all times in which blade, that is in the direction indicated by the arrow B which is the direction in which the V-shape crown points. Note that a straight downward force on top of the crown member will also activate the blade provided the force is not applied to the entire top surface, in which case the object applying the force will itself stop the blade from pivoting out of its slot due to the pressure of the object on the top of the blade. Note also that the blade member is arranged to retract back into its slot as soon as pressure is removed from the crown member. It does not remain activated.

Various modifications and changes to the preferred embodiments as described herein will be apparent to those skilled in this art. Accordingly, all such modifications and changes as fall within the scope of this invention are intended to be part thereof.

We claim:

1. A ring blade comprising:

a ring with a top section, said ring being adapted for placement on a user's finger;

a movable crown member mounted on said top section and having an elongate slot formed therein;

a blade member having a sharp edge and arranged in said slot; and pin means for pivoting said blade member from a retracted position where said sharp edge at least is located in said slot to an extended position where said sharp edge is exposed, said blade member being connected to said top section by said pin means;

wherein movement of said crown member towards said top section causes said pin means to pivot said blade member to the extended position.

2. A ring blade according to claim 1 wherein said top section has a V-shaped cavity with an open top and said crown member is also V-shaped, has a point at a bottom end of the V-shaped, and fits inside said cavity.

3. A ring blade according to claim 2 wherein said crown member has a protruding lip located at the point of its V-shape and said V-shaped cavity is undercut at its pointed end, the recess formed by the undercut accommodating said lip, whereby said crown member is pivotally mounted in said cavity by means of said pin means and said lip.

4. A ring blade according to claim 2 wherein the pointed end of said crown member is connected to said top section by means of a pivot pin, whereby said crown member is pivotally mounted in said cavity by means of said pivot pin and said pin means.

5. A ring blade according to claim 2 wherein said elongate slot extends in a lengthwise direction of the crown member from a point close to said point of the V-shape, said slot substantially dividing said crown member into two halves.

6. A blade ring according to claim 5 wherein said blade member is pivoted to the extended position when force is applied to said crown member in a direction which is downward and opposite to a direction in which V-shaped crown member points.

7. A ring blade according to claim 1 wherein said pin means comprise first and second steel pins, said first steel pin pivotally connects said blade member to said top section of the ring, and said second steel pin pivotally connects said blade member to the crown member.

8. A ring blade according to claim 7 wherein said crown member is hollow with an open bottom facing towards the top section of the ring, said top section is provided with two upwardly-extending lugs that extend into the hollow crown member and that are connected to said first steel pin, and said second steel pin extends through an enlarged hole formed in one end of said blade member.

9. A ring blade according to claim 7 including means for biasing said crown member to move away from said top section.

10. A ring blade according to claim 9 wherein said biasing means is a strip of rubber or rubber-like material sandwiched between said crown member and said top section.

11. A ring blade for cutting comprising:

a ring suitable for placement on a user's finger, said ring having a top section with a cavity formed therein;

a crown member pivotally mounted in said cavity and having a elongate slot formed therein;

a blade member having a sharp edge and arranged in said slot;

means connected to said blade member for pivoting said blade member from a retracted position where at least the sharp edge is located in said slot to an extended position where said sharp edge is exposed, said pivoting means being operated by pivoting said crown member.

12. A ring blade according to claim 11 including means for biasing said crown member to pivot away from said top section at one end thereof.

13. A ring blade according to claim 12 wherein said biasing means is a strip of rubber or rubber-like material sandwiched between said crown member and said top section.

14. A ring blade according to claim 11 wherein said pivoting means comprises a first pin member pivotally connecting said blade member to said top section of the ring and a second pin member connecting said blade member to said crown member.

15. A ring blade according to claim 14 including means for biasing said crown member to pivot away from said top section at one end thereof.

16. A ring blade according to claim 14 wherein said crown member is hollow with an open bottom facing towards the top section of the ring, said top section is provided with two upwardly-extending lugs that extend into the hollow crown member and that are connected to said first pin member, and said second pin member extends through an enlarged hole formed in one end of said blade member.

17. A ring blade according to claim 14 wherein said cavity is V-shape with an open top and said crown member is also V-shaped on its top.

18. A ring blade according to claim 17 wherein said blade member is pivoted to the extended position when force is applied to said crown member in a direction which is downward and opposite to a direction in which the V-shaped crown member points.

19. A ring blade according to claim 17 wherein said elongate slot extends in a lengthwise direction of the crown member from a point close to the point of the V-shape, said slot substantially dividing said crown member into two halves.

20. A ring blade according to claim 19 wherein said blade member is positioned entirely within said elongate slot in said retracted position, is made of stainless steel, and has a sharp point at one end that is exposed when said blade member is in the extended position.

* * * * *